US008393413B2

(12) United States Patent
Weston et al.

(10) Patent No.: US 8,393,413 B2
(45) Date of Patent: Mar. 12, 2013

(54) CLOSED LOOP CONTROL BORE HOLE DRILLING SYSTEM

(75) Inventors: John Lionel Weston, Chedzoy (GB); David Philip McRobbie, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 720 days.

(21) Appl. No.: 11/571,849

(22) PCT Filed: Jul. 6, 2005

(86) PCT No.: PCT/GB2005/002668

§ 371 (c)(1),
(2), (4) Date: Oct. 12, 2007

(87) PCT Pub. No.: WO2006/005916

PCT Pub. Date: Jan. 19, 2006

(65) Prior Publication Data

US 2008/0128171 A1 Jun. 5, 2008

(30) Foreign Application Priority Data

Jul. 9, 2004 (GB) ..... 0415453.0

(51) Int. Cl.
*E21B 7/04* (2006.01)
*E21B 47/02* (2006.01)

(52) U.S. Cl. ..... 175/61; 175/45

(58) Field of Classification Search ..... 175/107, 175/61, 62, 45; 464/8–21; 702/9
See application file for complete search history.

(56) References Cited

U.S. PATENT DOCUMENTS

| | | | | |
|---|---|---|---|---|
| 3,713,500 | A * | 1/1973 | Russell | 175/73 |
| 5,220,963 | A * | 6/1993 | Patton | 175/24 |
| 6,092,610 | A * | 7/2000 | Kosmala et al. | 175/61 |
| 6,158,529 | A * | 12/2000 | Dorel | 175/61 |
| 6,233,524 | B1 | 5/2001 | Harrell et al. | |
| 6,234,259 | B1 * | 5/2001 | Kuckes et al. | 175/73 |
| 6,467,557 | B1 | 10/2002 | Krueger et al. | |
| 6,714,870 | B1 | 3/2004 | Weston et al. | |
| 2002/0005297 | A1 | 1/2002 | Alft et al. | |
| 2002/0133958 | A1 * | 9/2002 | Noureldin et al. | 33/304 |
| 2004/0084219 | A1 | 5/2004 | Moore et al. | |

FOREIGN PATENT DOCUMENTS

| | | |
|---|---|---|
| EP | 0594418 | 4/1994 |
| EP | 0806542 | 11/1997 |
| GB | 2392931 | 3/2004 |
| WO | WO01/29372 | 4/2001 |

* cited by examiner

*Primary Examiner* — Kenneth L Thompson
(74) *Attorney, Agent, or Firm* — Conley Rose, P.C.

(57) ABSTRACT

A steerable bore hole drilling tool and method of drilling bore holes. The steerable bore hole drilling tool comprise means for mechanically decoupling the sensor unit from the tool body. The method comprises a step of mechanically decoupling the sensor unit form the tool body.

53 Claims, 8 Drawing Sheets

CLOSED LOOP CONTROL BORE HOLE DRILLING SYSTEM

CROSS-REFERENCE TO RELATED APPLICATIONS

This application is a National Phase entry of PCT Application No. PCT/GB2005/002668 filed 6 Jul. 2005 which claims priority to British Application No. 0415453.0 filed 9 Jul. 2004, both of which are incorporated herein by reference.

STATEMENT REGARDING FEDERALLY SPONSORED RESEARCH OR DEVELOPMENT

Not applicable.

The present invention relates to a tool and method for the closed loop control of the trajectory of a steerable drilling tool during the drilling of a bore hole.

BACKGROUND OF THE INVENTION

The extraction of oil and gas from reserves situated below the Earth's surface involves the drilling of bore holes from the surface to the reserves. Typically, a drilling tool with a drill bit attached to its lower end is used to drill such holes. The upper end of the drilling tool attached to a drill string or drill pipe, which is attached to a drive assembly at the surface. The drive assembly causes the drilling pipe to rotate which transmits the rotary motion to the drilling tool and the drill bit. As the drilling tool sinks deeper into the ground, extra sections of drill pipe are added to the drill string.

Furthermore, it is known to provide steerable drilling tools. There are various different types of steerable drilling tool and one example is described in detail below. However, steerable drilling tools typically are capable of bending in response to operator instructions so that the direction of the bore can be changed.

Documents GB 2 392 931A, U.S. Pat. No. 6,233,524B1, WO 01/29372A1 and EP 0 806 542A2 all disclose steerable drilling tools.

One example of steerable drilling tools are rotary steerable tools. Whilst a rotary steerable tool may vary in principle, it will generally comprise of a bias or steering unit which exerts a force, either internally on a flexible central shaft or externally on the borehole wall to affect a change in the steering geometry to the desired direction.

In one mechanisation, the drill pipe is connected to a drive unit located at the surface and transmits the rotary motion of the drive unit via the rotary steerable tool to the drill bit. The rotary steerable tool comprises a flexible central shaft which is connected at its top end via the necessary connections to the drill pipe. The bottom end of the flexible shaft is similarly connected to the drill bit. The flexible shaft is supported by two bearing systems, one at either end. The upper bearing is designed to prevent bending of the shaft above it and the lower bearing is typically of the angular contact type and thus allows movement of the shaft above and below it.

Between the two bearings, around the centre of the length of the flexible shaft, is a bend unit that deflects the shaft. Various mechanisms may be implemented to cause the flexible shaft to be deflected to the designated amplitude so as to cause the correct angular deflection of the shaft in the required direction. It will be apparent that the portion of the flexible shaft located below the angular contact bearing will move in the contra-direction to the portion of the flexible shaft located immediately above the bearing in the bend unit. Other rotary steerable designs exist which generate deflection by alternative methods, for example, eccentric pressure pad application.

Alternatively, the rotary steerable tool may be connected to a device known as a mud motor. Fluid, known as mud, is pumped down the drill string into the mud motor which is positioned between the drill string and the rotary steerable tool. An impeller within the mud motor is driven by the movement of the fluid . The impeller is in turn connected to the rotary steerable tool, and thus the drill bit can be rotated.

Rotary steerable tools typically incorporate a reference stabilised housing which is de-coupled, either actively or passively, from the drill string. For example, the outer housing may be restrained from rotating with respect the drill hole walls by a reference stabiliser located along the outer housing. The stabiliser may comprise a plurality of guides, and in particular may be three or four sets of sprung rollers or contact pads which may accommodate over-gauge hole sections. The outer stabilised housing may in fact rotate in the same sense as the drill bit, but at a very slow rate as the system progresses down the hole. The reference stabiliser is designed and operated to ensure that the ratio of drill bit to outer housing turn rate does not exceed a fixed limit.

It can therefore be appreciated that as the drill bit and rotary steerable tool progress along the drilled bore hole, the trajectory of the assembly, and hence that of the borehole, can be controlled. This control is typically actioned and supervised by a drilling operator at the surface or start location of the bore hole.

In addition to operator controlled drilling, it is known to provide automated guidance of drilling tools using closed loop control systems. In order to implement automated guidance of the drilling tool using closed loop control, continuous, accurate information concerning the direction or position of the drill bit is required. In the absence of such information, drilling operator intervention may be required in order to ensure that the drill bit follows the desired bore hole path. However, in the oil and gas industries, the drilling environment can be particularly inhospitable. The vibrations caused by the drilling tool make it difficult to obtain the continuous, accurate information required. Furthermore, these problems are made worse at greater depths. In view of these factors, closed loop control drilling systems are generally difficult to implement in the oil and gas industries.

Document US 2002/0005297 A1 discloses a closed loop control system for use in the drilling of horizontal underground utility lines. Such lines are typically, drilled in soft sub-surface earth and the drilling system is thus not exposed to the same inhospitable environment experienced in the drilling of oil and gas bore holes. In view of this, this document does not address the problems outlined above in relation to providing continuous and accurate results.

Document U.S. Pat. No. 6,233,524 B1 also discloses a closed loop control system. This document is mainly concerned with extending drill life and improving drilling efficiency by taking various measurements relating to operating conditions and operating the drilling tool accordingly. The document also discloses that the system may be implemented as a navigation device. Although the system is designed for use in oil and gas drilling, it does not address the problems associated with obtaining continuous and accurate results.

GB 2 392 931A also discloses a closed loop control system.

In addition to the above disclosures, several techniques for obtaining directional/positional information are known as described in the following.

Measurement While Drilling (MWD) survey tools are located above the rotary steerable tool in the Bottom Hole Assembly (BHA). BHA is the term used to refer to the components and instruments positioned at the bottom of the drill string. The BHA does not necessarily include the drilling tool itself and in the present application the term BHA is used to refer to the components and instruments placed between the drilling tool and the drill string.

Such MWD survey tools comprise magnetometers and inclinometers which provide the drilling operators respectively with azimuthal deviation data (from a reference, e.g. magnetic north) and inclination measurements relating to the portion of bore hole in which the MWD survey tool and the BHA are currently located. When taken together these measurements provide information concerning the trajectory of the bore hole. Typically, the distance of the MWD survey tool from the surface, i.e. the well bore path length, is derived from the length of drill pipe which has been inserted into the well bore behind the MWD survey tool. Thus, the drilling operators are provided with the attitude (azimuth direction and inclination) of the bore hole at a given bore hole length. This information can be used by the drilling operators to guide the rotary steerable drilling tool.

However, there are various problems with the accuracy and latent reaction time of such a set-up. Firstly, given that the rotary steerable tool can be more than 18 feet long, the conventional MWD survey tool is located a considerable distance from the drill bit. Thus, if the drill bit veers off the desired trajectory (for example owing to rock mechanics) the drilling operator remains unaware of this condition until the MWD survey tool reaches the point at, or beyond which the unplanned deviation occurred. At this time the drill bit has progressed considerably along the deflected trajectory. Only at this point is the drilling operator aware that corrective action may be necessary.

MWDs cannot be placed on or near rotary steerable tools as MWDs comprise magnetometers and rotary steerable tools are constructed using magnetically permeable materials. Furthermore, magnetic sensors generally are difficult to operate on or near rotary steerable tools. Rotary steerable tools can be made out of non-magnetic permeable materials, but this is very expensive and generally avoided. Furthermore, even if non-magnetic materials were used in the construction of the rotary steerable tool, the presence of large diameter steel rotating bodies can result in induced electromagnetic forces generating variable, unstable magnetic fields which preclude the use of magnetometers or result in spurious sensor data. Magnetic interference may also result from the control or line currents within the rotary steerable tool. In particular, the system control circuits may create unstable magnetic fields resulting in local disturbances.

Secondly, as MWD survey tools are typically located within the BHA at the lower end of the drill string, while drilling is in progress, the MWD survey tool is subjected to a high degree of vibration and rotary forces. This makes it difficult to obtain accurate continuous survey data while drilling is in progress. Thus, in typical well bore drilling set-ups, drilling is stopped from time to time in order that accurate surveys may be undertaken, normally at pipe connections (typically at 30 m intervals).

Thirdly, the drill string is typically made up of multiple segments of drill pipe with the BHA located at the lower end. The BHA also comprises tubular components of variable cross section, diameter and length. Both the drill string and BHA are limber in nature which enables the drill string to progress along the variable radius curves of the drilled bore hole.

The BHA is normally composed of larger diameter, thicker walled, components, and is less limber than the drill string. In most, but not all, drilling applications, the BHA is stabilised and is nominally held concentric to the central axis of the bore hole. The standard MWD direction tool is in turn centralised within the BHA, thus providing sensor attitude data which can be said to represent the local bore hole axis, but not necessarily that of the newly drilled hole some distance below or ahead of the MWD tool.

The inherent flexibility of the BHA, and specifically, its connection to the rotary steerable system, is a necessary design attribute enabling the steering system to operate quasi-independently of the reaction forces of the BHA above. Hence, the rotary steerable system can be used to deflect the path of the bore hole in any desired attitude and direction.

For the above reasons, MWD survey tools of the type described above are not ideal for use in closed loop control systems.

At Bit Inclination (ABI) sensors (accelerometers) which are located within the outer housing of the rotary steerable tool itself are also known. Such sensors are typically within a few feet of the drill bit and can thus detect relatively quickly any undesired changes in bore hole inclination at or immediately behind the drill bit trajectory and the bore hole axis. However, this sensor configuration does not provide actual azimuthal change. For example, if the drill bit veers from the desired azimuthal trajectory, but maintains the desired inclination, the operator would not be aware of this condition until the MWD survey tool data becomes available for the relevant section of hole. Additionally, the bore hole, at drill bit depth, would have strayed further from the intended trajectory.

For the above reasons, ABI sensors of the type described above are also not ideal for use in closed loop control systems.

Documents US 2002/0005297 A1, U.S. Pat. No. 6,233,524 B1 and GB 2 392 931A were mentioned above in relation to disclosures of closed loop control systems. However, as discussed above, non of these documents address the issues relating to obtaining continuous and accurate sensor readings during the drilling process.

In document US 2002/0005297 A1, the down-hole sensors are positioned in a drill tube which is positioned proximate and rearward of the drilling tool. Positioning the sensors in such a manner has the same draw backs as described above in relation to the MWD. Thus, no solution is provided to the problem of providing continuous and accurate results.

In documents GB 2 392 931A and U.S. Pat. No. 6,233,524 B1, there is no disclosure relating to the problems associated with providing continuous and accurate results, and thus there is no disclosure relating to the positioning of the sensors in order to overcome these problems.

Documents WO 01/29372A1 and EP 0 806 542 A2 both relate to steerable drilling tools, however neither document discloses closed loop control of the direction or position of the drilling tool on the basis of sensors measuring the direction or position of the drilling tool. Neither document highlights the problems associated with the need to provide continuous and accurate results.

Thus, the above described prior art does not disclose any solutions to the problem of providing continuous and accurate sensor measurements for use in automated guidance of a drilling tool using closed loop control. The lack of continuous, accurate information concerning the direction of the drill bit, or reference quality positional information, means that drilling operator intervention is required in order to maintain the drill bit trajectory along the pre-planned well path in such systems.

SUMMARY OF THE INVENTION

The present invention provides a steerable bore hole drilling tool comprising: a tool body having a first end connectable to a drive means and a second end connectable to a drill bit, the tool body arranged to transmit rotary motion from said first end to said second end and comprising deflection means 70 arranged to deflect said second end away from a longitudinal axis of the tool body; a sensor unit; estimation means arranged to estimate the direction and/or position of the tool body on the basis of the output of said sensor unit; control means for calculating the difference between the estimated direction and/or position and corresponding pre-stored direction and/or position information and for controlling said deflection means so as to deflect said second end on the basis of said difference; and decoupling means arranged to mechanically decouple said sensor unit from the tool body.

By mechanically decoupling the sensor unit from the drilling tool, in use, the motion and vibrations generated by the drilling tool are reduced and preferably eliminated by the decoupling means. In this manner, a benign environment is provided for the sensor unit such that continuous and accurate readings may be obtained.

In a preferred embodiment the decoupling means is mechanically decoupled from the rotary motion of the drilling tool. The decoupling means therefore remains stationary, or near stationary, with respect to an Earth fixed reference frame. In this manner, the output of the sensors is improved and preferable perfected and in particular, gyroscopes may be utilised.

Preferably, the decoupling means and the sensor unit are positioned towards the second end of the main tool body. Thus, if the rotary steerable tool is caused to move away from the desired trajectory, by for example, rock mechanics, the sensor unit will be able to provide immediate indication of this.

By utilising said decoupling means, the vibratory forces experienced by the sensor unit are considerably lower than would be experienced by the sensor unit if placed in the BHA, above the rotary steerable tool. Thus, the sensor unit is able to provide accurate measurements when drilling is in progress.

In one embodiment, the main body of the rotary steerable drilling tool further comprises a flexible shaft, positioned within the main body, and a non-flexible shaft, positioned between the first end of the main body and the flexible shaft, wherein the sensor unit is positioned within the non-flexible shaft.

Preferably, the main body of the rotary steerable tool further comprises a rotationally stable platform positioned within the non-flexible shaft, wherein the sensor unit is positioned on the rotating platform. The stable platform is arranged to rotate in the contra direction in which the drill string and shafts of the rotary steerable tool are rotating. Thus the sensor unit may be kept substantially stationary with respect to the fixed Earth axis. A suitable rotary platform is described in WO 01/29372.

In a preferred embodiment said main tool body further comprises an outer housing and said sensor unit is positioned within the outer housing.

The outer housing of the rotary steerable tool is preferably stabilised and remains nominally static for much of the drilling process, turning only slowly as drilling progresses. For example, the rotary motion may be restrained by contact between a reference stabiliser, located along the outer body of the rotary steerable tool, and the wall of the bore hole. In addition, this continuous contact with the wall results in much of the shock and vibration being attenuated significantly, in comparison to the levels of motion that can normally be experienced by down-hole equipment whilst drilling is taking place. Hence, the levels of shock and vibration experienced by the inertial sensors are much attenuated which enables meaningful measurements to be obtained continuously throughout the drilling process.

Preferably, the sensor unit is an Inertial Measurement Unit (IMU). Preferably, the inertial measurement unit (IMU) comprises gyroscopic sensors together with accelerometers which measure angular rate and linear acceleration respectively. More preferably the IMU comprises orthogonal triads of linear accelerometers and gyroscopes.

Preferably, the rotary steerable tool further comprises a signal processor, which together with the IMU constitutes an inertial measurement system. This system may be configured either as an attitude and heading reference system to provide directional survey data, or as a full inertial navigation system (INS) in order to provide both directional and positional survey data.

The provision of continuous, accurate information concerning the direction and/or position of the rotary steerable drilling tool and/or drill bit by the use of a decoupling means enables the implementation of an automated guidance system using closed loop control. The computational capability necessary to implement such a system may be located either at the surface or within the bottom hole assembly. Depth and/or bore-hole path length information may be transmitted from the surface and combined with the inertial measurements concerning inclination and azimuth. These data may then be compared with a pre-planned trajectory. The pre-planned trajectory can be expressed in angular form as a function of path length, or as positional coordinates. The computational system then provides the bend unit, or steering system, with instructions to maintain the drill bit within the path limits of the pre-planned trajectory.

The Inertial Measurement Unit (IMU) can operate without magnetometers, and preferably does not comprise magnetometers. It is thus not usually susceptible to magnetic interference. This being the case, it can be located on the rotary steerable tool. By positioning the IMU on the rotary steerable tool, the relationship between the longitudinal axis of the IMU and the longitudinal axis of the rotary steerable will be known. Indeed in preferred embodiments, the axes will be the same. Thus the relationship between the measurements taken by the IMU and the direction and/or position of the rotary steerable tool will also be known enabling accurate determination of the direction and/or position of the rotary steerable drilling tool (and thus the drill bit). In addition, by placing the IMU on the rotary steerable tool, it is located closer to the drill bit than would be the case if it were placed in the BHA (as is the case for conventional MWD survey tools) above the rotary steerable system.

Alternatively, instead of deflecting said second end on the basis of the difference, said deflection means 70 deflects said second end in response to said difference.

The drive means may be any suitable mechanism for driving the rotary steerable tool. In particular however, the drive means may be a surface motor which is connected to the tool via the drill string. Rotary motion is transmitted from the surface, through the drill string, to the tool. Alternatively, the drive means may be a mud motor located in the Bottom Hole Assembly. The mud motor comprises an impeller which is driven by fluid which is pumped down the drill string from the surface. The rotary motion is then transmitted to the tool. Alternatively, the surface motor and mud motor may be used in combination to improve efficiency.

In a further aspect, the present invention provides a method of drilling bore holes comprising the steps of: connecting a steerable rotary drilling tool to a drill bit and a drive means; rotating the steerable rotary drilling tool using said drive means so as to cause the drill bit to rotate and commence drilling; estimating the direction and/or position of the drilling tool on the basis of the output of a sensor unit of the steerable rotary drilling tool; calculating the difference between the estimated direction and/or position and corresponding prestored direction and/or position information; and deflecting the steerable rotary drilling tool on the basis of said difference; wherein said estimating step includes a step of mechanically decoupling said sensor unit from a tool body of said steerable rotary drilling tool.

In yet a further aspect, the present invention provides a method of drilling bore holes comprising the steps of: connecting a steerable rotary drilling tool a to drill bit and a drive means; rotating the steerable rotary drilling tool using said drive means so as to cause the drill bit to rotate and commence drilling; estimating the direction and/or position of the drilling tool on the basis of the output of a sensor unit of the steerable rotary drilling tool, the sensor unit being mechanically decoupled from the tool body of said steerable rotary drilling tool; calculating the difference between the estimated direction and/or position and corresponding prestored direction and/or position information; and deflecting the steerable rotary drilling tool on the basis of said difference.

BRIEF DESCRIPTION OF THE DRAWINGS

The present invention will now be described by way of example only and with reference to the accompanying drawings in which.

DESCRIPTION OF THE PREFERRED EMBODIMENTS

FIGS. 1*a*, 1*b*, 1*c* and 1*d* show a rotary steerable tool 1 connected to a drill bit 3 in preferred embodiments of the present invention. Like features are referenced with like numerals. The closed loop control system will be described in more detail below, however first the positioning of the sensors will be described.

As noted above the mechanical decoupling of the sensors from the motion and vibration of the drilling tool allows continuous and accurate measurements to be obtained.

Figure 1A:
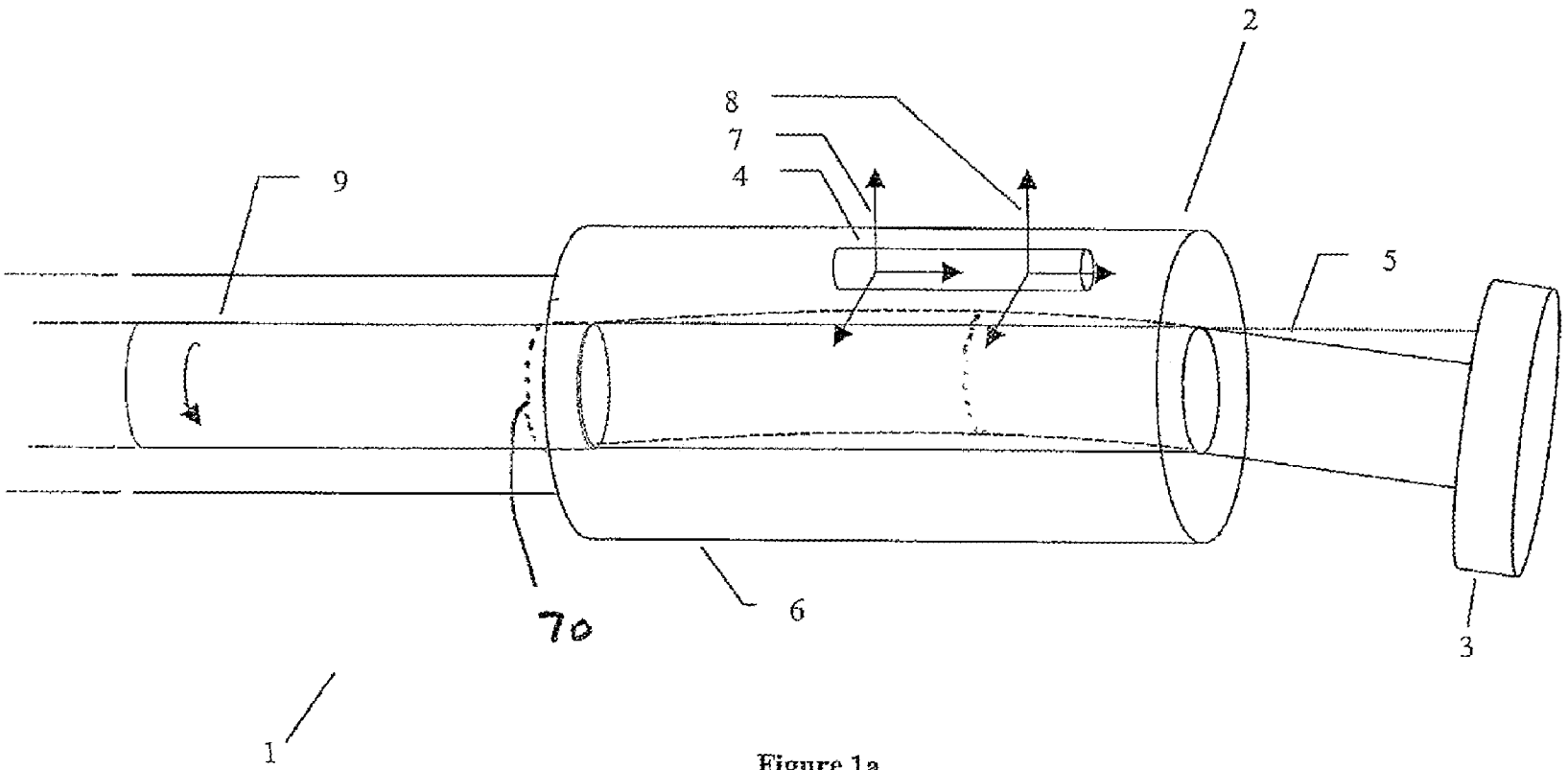
FIGS. 1*a*, 1*b*, 1*c* and 1*d* are schematic representations of the well-bore guidance system in four alternative embodiments of the present invention.

The first embodiment is shown in FIG. 1*a*. The sensors are positioned in the outer housing 6 of the rotary steerable tool. The outer housing remains stationary or near stationary with respect to the Earth fixed reference frame.

Figure 1B:
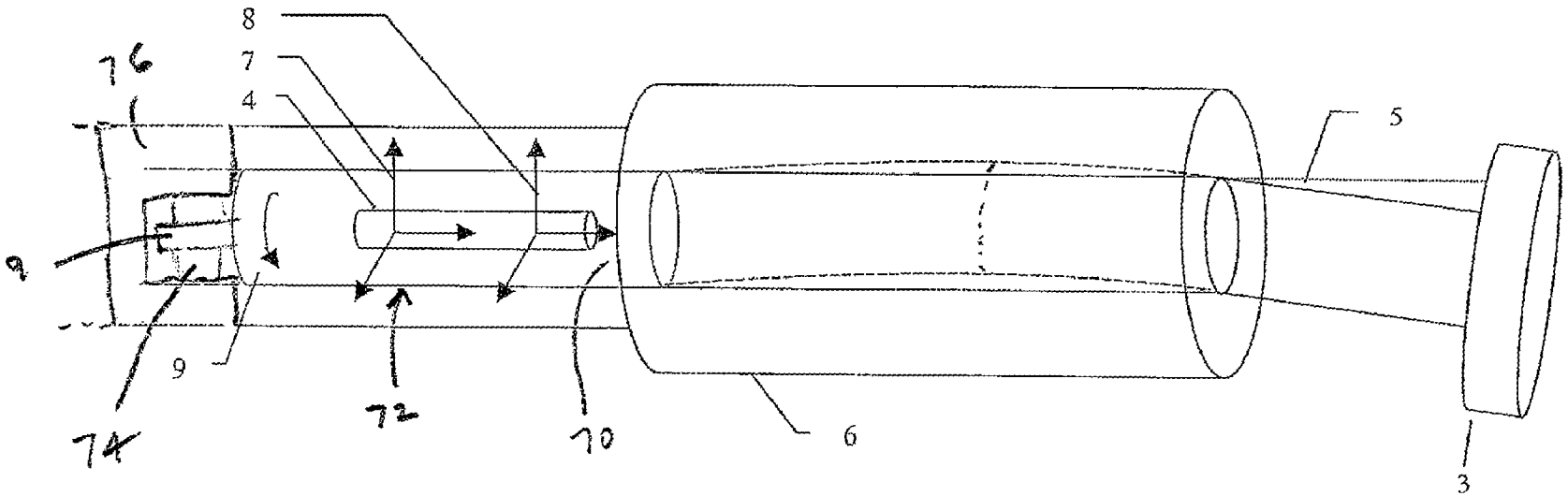

The second embodiment is shown in FIG. 1*b*. A rotating platform 72 is provided in the rotating shaft 9 at the up-hole end of the drilling tool. The rotating shaft 9 may include a flexible shaft 5 and a non-flexible shaft 5' in which is positioned a rotationally stable platform. The sensors are positioned on the rotating platform 72. The platform is provided with sensors which detect the rate of rotation of the rotating shaft. The platform is then caused to rotate in the opposite direction to the rotating shaft 9 by a drive unit 74 but at the same rate. The drive unit 74 is mounted on a flange 76 mounted within the tool such as shown in WO 01/29372A1. In this manner, the sensors remain stationary or near stationary with respect to an Earth fixed reference frame. Thus, the sensors remain stationary or near stationary with respect to the surrounding earth.

Figure 1C:
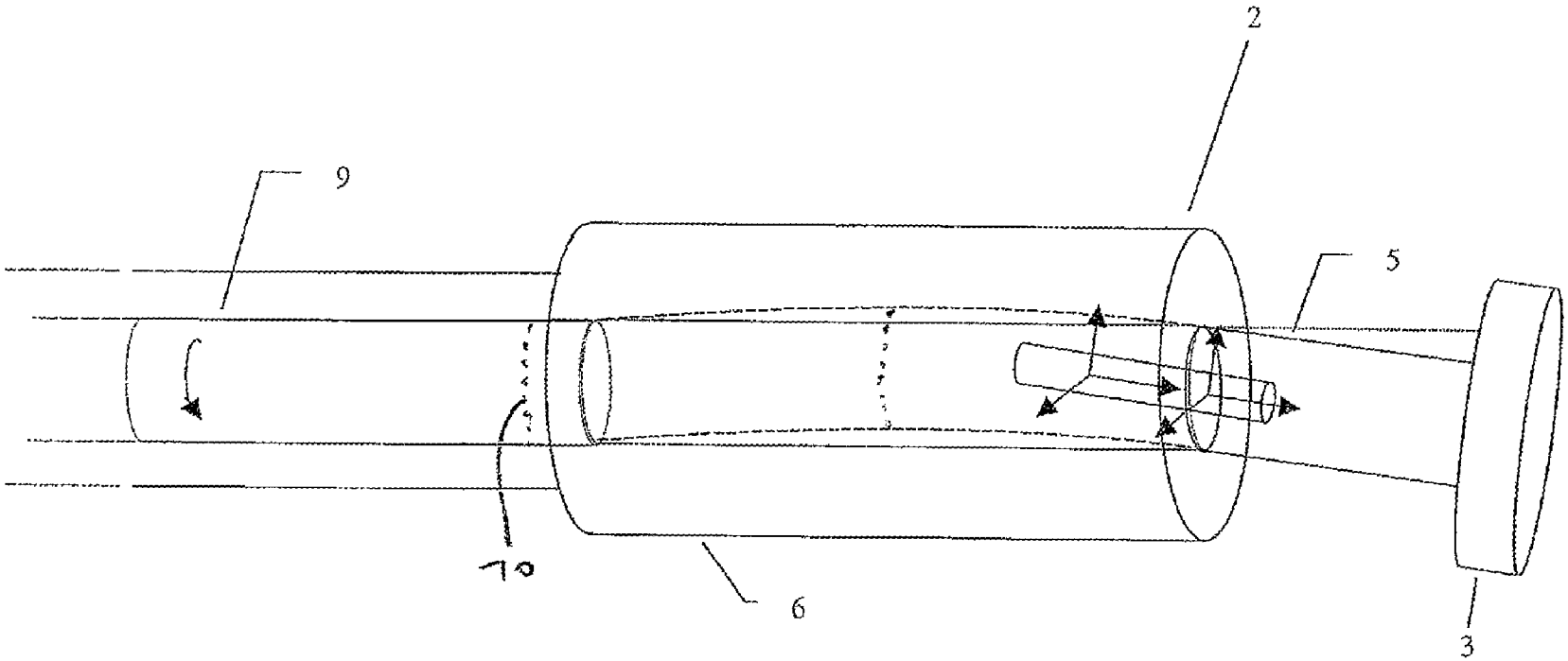

The third embodiment is shown in FIG. 1*c*. The rotating platform of embodiment two, is positioned closer to the drill bit so that the sensor measurements more closely relate to the current drill direction/position.

Figure 1D:
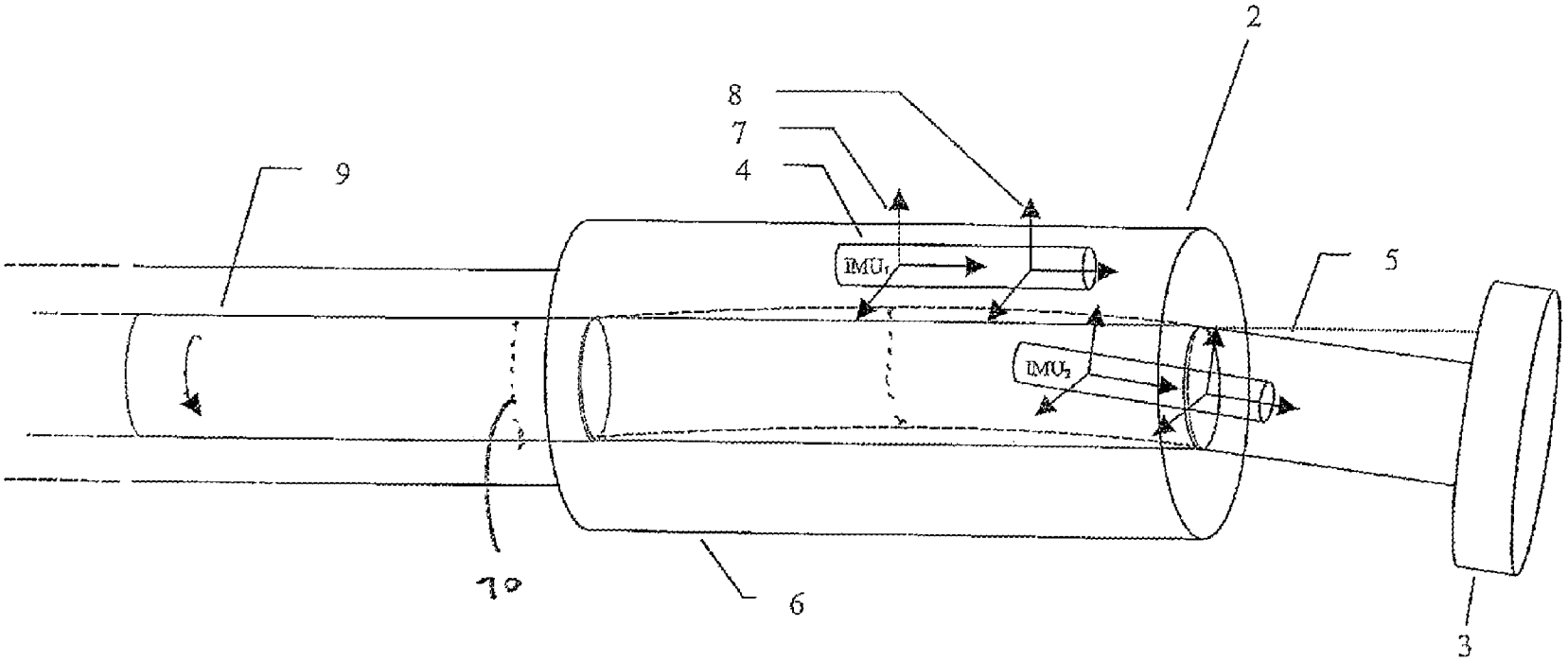

The fourth embodiment is shown in FIG. 1*d*. The drilling tool is provided with two sensor arrangements. The first is positioned in the non-rotating outer housing as per embodiment one and the second is positioned in the rotating shaft as per embodiment three. By using multiple sensor arrangements, the measurement redundancy of the system is improved.

The sensors may also be placed on a rotating platform positioned in drill string immediately behind the drilling tool.

The rotary steerable tool comprises an inertial measurement unit (IMU) 4, a flexible shaft 5 and an outer housing 6. The IMU provides measurements of acceleration and angular rate about three orthogonal acceleration axes 7 and three orthogonal gyro axis 8 respectively.

A computer (not shown) calculates on the basis of these measurements, the direction, i.e. inclination and azimuthal deviation, and/or the position of the IMU. The computer can also calculate the velocity of the IMU. Given that the spatial relationship between the IMU and the drill bit is known, the calculations of spatial position and velocity can be extrapolated to provide a measure of drill bit direction, position and velocity. The tool face deflection angle can also be calculated. The IMU and computer together form an inertial measurement system. This system may be configured either as an attitude and heading reference system to provide directional survey data, or as a full inertial navigation system (INS) in order to provide both directional and positional survey data. The direction and/or position of the drill bit are calculated with respect to a pre-determined reference frame. In addition, the computer may be provided with depth/well bore hole path length information. In full inertial navigation mode, depth information may be used to obtain accurate co-ordinate position data. By combining the inertial system data with independent depth measurements, it is possible to bound the growth of inertial system error propagation.

Figure 4:
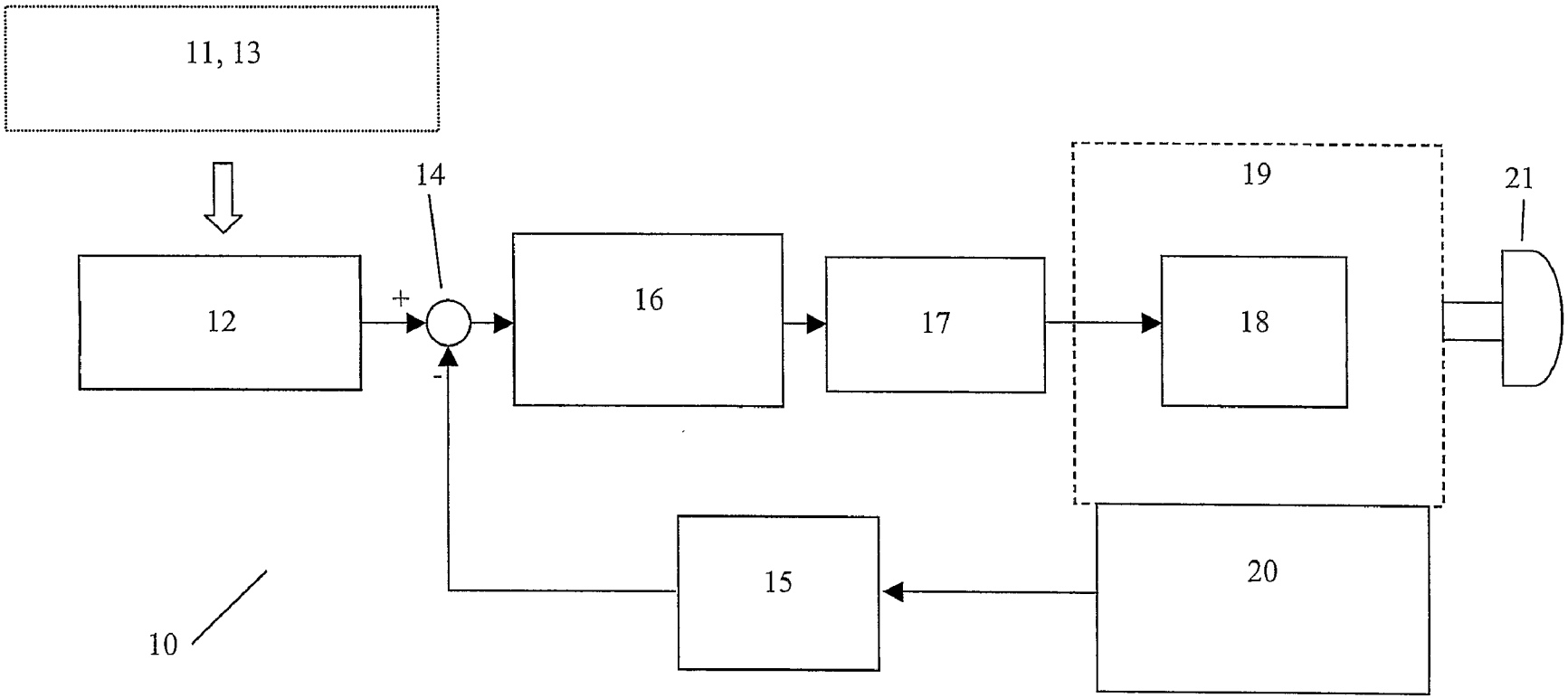
FIG. 4 shows how steering commands are generated in a down-hole closed loop control system in one embodiment of the present invention.

FIG. 4 shows the down-hole closed loop control system 10 in the preferred embodiment of the present invention. Initial surface input data 11, which comprise start co-ordinates and planned bore-hole trajectory, are input into target position means 12 together with continuous measured bore path length updates 13 (surface to rotary steerable system). The target position means generates target direction and/or position information as a function of bore hole path length. This information is then input into a difference means 14 together with INS direction and/or position estimate information from the INS 15. The difference between the planned direction and/or position and actual direction and/or position is then input into well bore axes resolution means 16. The well bore axes resolution means then resolves the direction and/or position differences into well bore axes. This information is then fed into steering command generation means 17, which generates steering commands to pass to the rotary steerable tool bend unit 18 in the rotary steerable tool 19. The rotary steerable tool incorporates an Inertial Measurement Unit 20 and is connected to a drill bit 21.

Figure 5:
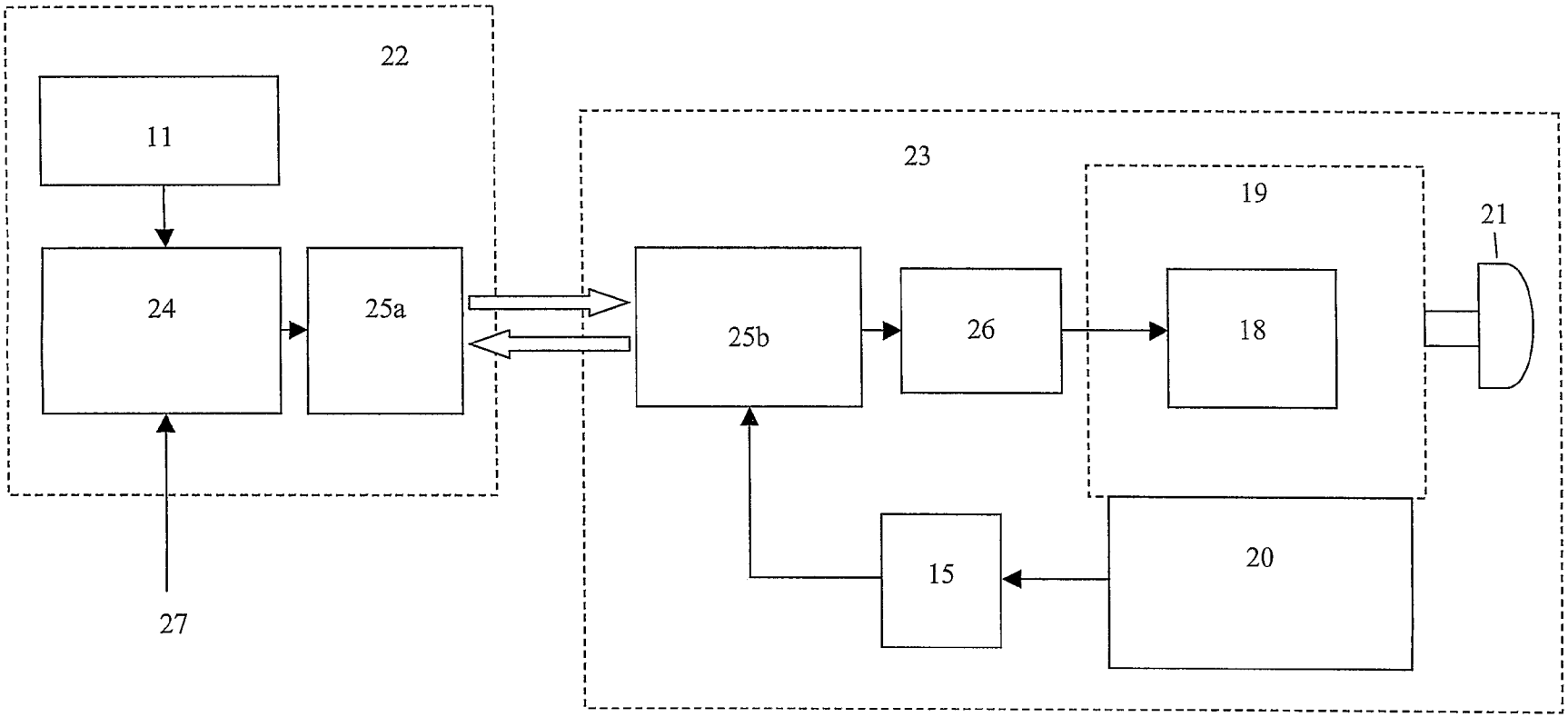
FIG. 5 shows how steering commands are generated in a surface control system with possible manual intervention in one embodiment of the present invention.

FIG. 5 shows a similar system in an alternative embodiment of the present invention in which the closed loop control system is located on the surface in a surface unit 22. In FIG. 5, features which correspond to those shown in FIG. 4 are referenced with like numerals. The additional features are a down hole unit 23, a surface control unit 24, a two-way communications link 25, a drive unit 26 and operator interface 27. The provision of the closed loop control system at the surface allows for possible operator intervention in circumstances where this is necessary. For example, if problems are encountered during the automated guidance process and a change of well-bore trajectory is required.

Thus by utilising an Inertial Measurement System, which provides continuous and accurate information concerning the direction and/or position of the drill bit, and comparing this information with pre-planned well bore trajectory information, a closed loop control system for the automatic guidance of rotary steerable tools is achieved.

In the embodiment in which only direction calculations are used, the estimated inclination and azimuth readings at a given well depth/bore hole path length are compared with a stored profile of these quantities corresponding to the required well profile. Steering commands are then generated in proportion to the difference between these estimates. The differences between the desired and estimated inclination and azimuth are resolved into steering tool axes, using the estimated tool face angle, to form the signals to be passed to the bend unit of the rotary steerable tool.

In the embodiment in which position calculations are used, the position estimates, which may be generated in a local vertical geographic reference frame, are compared with the desired trajectory profile specified in the same coordinate frame, as a function of well depth. In vector form:

$$\Delta x^R(d)=\hat{x}^R(d)-x^R(d)$$

where $x^R(d)$=reference trajectory position at depth d, specified in reference axes $\hat{x}^R(d)$=estimated position at depth d, specified in reference axes $\Delta x^R(d)$=position error depth d, specified in reference axes The differences between the estimated and desired positions are transformed into well bore axes using the attitude estimates generated by the inertial measurement unit, to form:

$$\Delta x^W(d)=\begin{bmatrix}\Delta x\\ \Delta y\\ \Delta z\end{bmatrix}=C_R^W(d)\Delta x^R(d)$$

where $C_R^W(d)$=direction cosine matrix relating reference and well bore axes $\Delta x^W(d)$=position error at depth d, specified in well bore axes $\Delta x$, $\Delta y$, $\Delta z$=components of position error The z axis of the well bore coordinate frame (xyz) is coincident with the along-hole axis of the well, and the x and y axes are perpendicular to z and to each other. Steering commands ($\alpha$ and $\beta$) are then derived as a function of the lateral positional errors specified ($\Delta x$ and $\Delta y$) in well bore axis:

$$\alpha=_{K\alpha}\Delta x$$

$$\beta=K_\beta\Delta y$$

Other control strategies may be adopted, rather than the simple form shown here. For example, steering signals may be derived taking into account the rates of change of the position error components.

In practice, the closed loop operation would include activation or reaction limits which could be specified or changed as required. This feature would inhibit the response of the control system to small measurement variations, thus suppressing mico-tortuosity in the drilled well path, the objective being to provide a smooth well path to the target location. The activation limit settings will be governed by prevailing drilling conditions and formation effects.

Figure 2:
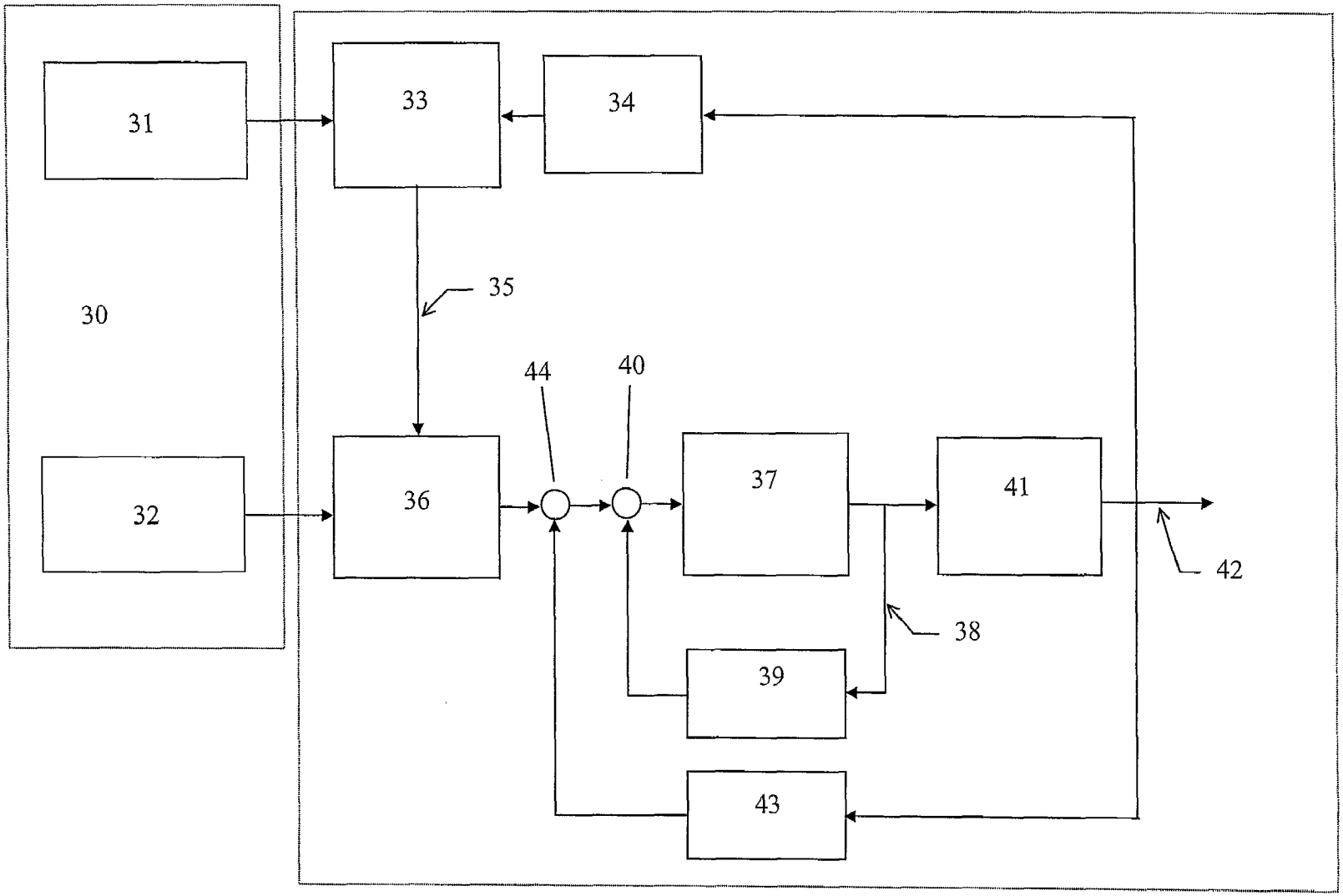
FIG. 2 is a block diagram of an inertial navigation system in one embodiment of the present invention.

FIG. 2 shows the main computational blocks of an INS in one embodiment of the present invention. The INS is shown here in configuration for drill bit position calculation.

FIG. 2 shows the IMU 30 which comprises gyroscopes 31 and accelerometers 32. The measurements taken by the gyroscopes concerning angular rate are passed to an attitude computation means 33. The attitude computation means uses the angular rate measurements and information concerning the Earth's rate 34 and computes the attitude of the IMU. This is output in the form of a direction cosine matrix 35. An acceleration output resolution means 36 takes the acceleration measurement information output from the accelerometers and the direction cosine matrix and passes this information onto a navigation computation means 37. The navigation computation means then produces inertial navigation system (INS) velocity estimates 38.

The estimates 38 are first fed into a Coriolis correction means 39, the output of which is added by means 40 to the input of the navigation computation means forming a first feed back loop. The INS velocity estimates are second fed into a velocity integration means 41 which produces INS position estimates 42. The position estimates are first fed into a gravity computation means 43 the output of which is added by means 44 to the input of the navigation computation means forming a second feed back loop. The INS position estimates are also used to compute the components of Earth's rate which are fed into the attitude computation means. Finally the INS position estimates are output from the INS to provide positional information.

Figure 3:
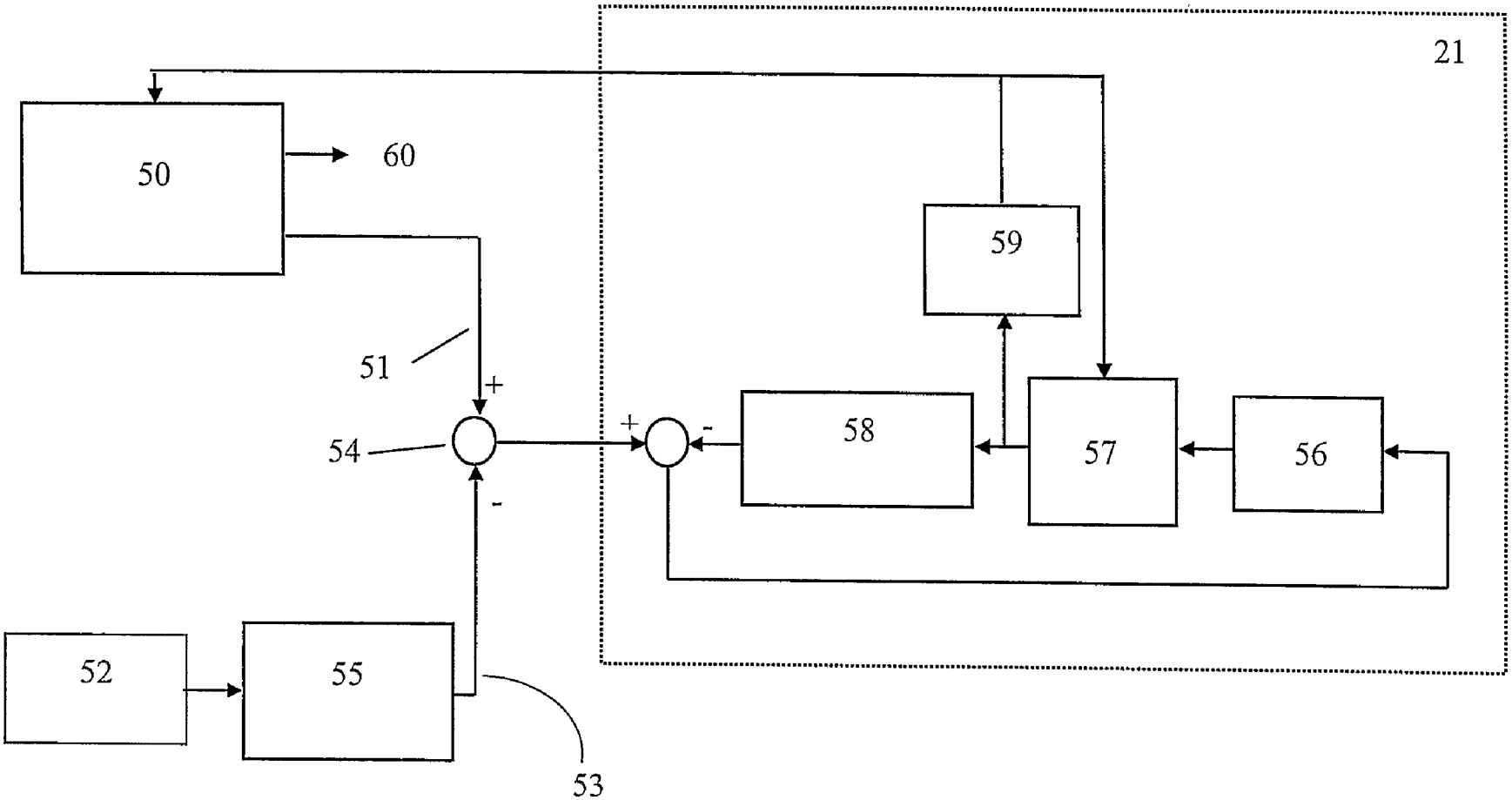
FIG. 3 is a block diagram showing the use of depth information in conjunction with the inertial navigation system in one embodiment of the present invention.

In order to limit, or bound, the growth of errors in the INS arising as a result of instrument biases and other errors in the sensor measurements, independent measurements of bore hole path length may be used. These measurements are compared with estimates of the same quantities derived from the INS outputs and used to correct the INS as indicated in FIG. 3. Alternatively, zero velocity updates may be applied at pipe connections when the down hole system is known to be stationary, to achieve a similar effect.

FIG. 3 shows INS 50 path length estimates 51 being differenced with depth sensor 52 path length estimates 53 by difference means 54. The INS path length estimates are derived from the INS position estimates and are received from the INS 50. The depth sensor path length estimates are derived from a depth sensor 52 and signal processor 55. The difference between the two sets of estimates is then passed to an error model filter 21 which may be a Kalman filter. The error model filter first applies a gain to the difference data at gain means 56. The output of the gain means is fed into an INS error model means 57, the output of which is fed into a measurement model means 58 and a resent control means 59. The output of the measurement model means is taken away from the difference data which is initially input into the error mode filter and the resultant signal is input into the gain means. The output of the resent control means is input into the INS error model and the INS itself. Thus the INS is able to output a corrected estimate of borehole trajectory 60.

As described above, the IMU provides measurements of acceleration and angular rate about three orthogonal axes. This is typically achieved using three single axis accelerometers and three single axis gyroscopes, the axes of which are mutually orthogonal. Alternatively, the three single axis gyroscopes may be replaced by two dual-axis gyroscopes. Whilst it is often the case that the sensitive axes of the inertial sensors are configured to be perpendicular to one another, this is not essential, and a so-called skewed sensor configuration may be adopted. Provided the sensitive axis of one of accelerometers and one of the gyroscopes does not lie in the same plane as the sensitive axes of the other two accelerometers and gyroscopes respectively, it is possible to compute the required readings about three mutually orthogonal axes.

In addition to the survey data produced by the IMU system described above, other survey data generated by a conventional MWD survey tool located further up the tool string may be used in correlation with the IMU calculations. These data would provide additional survey checks and an increased confidence in the calculated well path position.

Furthermore, it will be appreciated that sensors other than an IMU may be used to achieve the measurements required to implement the present invention. The main requirements for any such sensors being that they generate measurements which can be used to calculate direction or position.

Although the present invention has been described for use with a drill string, driven from the surface, it will be appreciated that other drive mechanisms may also be used in addition to or in place of the drill string/surface drive mechanism. For example, additional drill bit rotation may also be accomplished by means of a downhole motor placed within the Bottom Hole Assembly (BHA) providing an alternative or additional means of bit rotation. In particular, a mud motor of the sort described above may be utilised.

It will be appreciated that the invention described above may be modified.

The invention claimed is:

1. A steerable bore hole drilling tool comprising:

a tool body having a first end connectable to a drive member and a second end connectable to a drill bit, the tool body arranged to transmit rotary motion from said first end to said second end;

a deflection member disposed on the tool body to deflect said second end away from a longitudinal axis of the tool body;

a sensor unit;

estimation means arranged to estimate the direction and/or position of the tool body on the basis of the output of said sensor unit;

control means for calculating the difference between the estimated direction and/or position and corresponding pre-stored direction and/or position information and for controlling said deflection member so as to deflect said second end on the basis of said difference; and a counter-rotating platform disposed on the tool body, said sensor unit being disposed on said counter-rotating platform, wherein said counter-rotating platform is arranged to mechanically decouple said sensor unit from the tool body, and said counter-rotating platform is further arranged to decouple said sensor unit from the rotary motion of said tool body, such that in use, the sensor unit does not move relative to an Earth fixed reference frame.

2. The tool of claim 1 wherein said sensor unit is rotatably disposed on said tool body to rotate in a direction opposite the direction of the rotary motion of said tool body, such that in use, the sensor unit remains substantially stationary with respect to an Earth fixed reference frame.

3. The tool of claim 1 wherein said tool body has an outer housing and the sensor unit is positioned within the outer housing wherein, in use, said outer housing remains substantially stationary with respect to an Earth fixed reference frame.

4. The tool of claim 1 wherein said platform comprises a drive unit disposed on the tool body to rotate the platform.

5. The tool of claim 4 wherein said platform further comprises a rotation sensor, arranged to detect the rate of said rotary motion transmitted from the first end to the second end of the tool body.

6. The tool of claim 4 wherein said drive unit is further arranged to rotate said platform, in response to said detected rate, such that said platform remains substantially stationary with respect to an Earth fixed reference frame.

7. The tool of claim 1 wherein said counter-rotating platform is located within a rotating shaft of said tool body towards the second end of the tool body.

8. The tool of claim 1 wherein said counter-rotating platform is located within a rotating shaft of said tool body towards the first end of the tool body.

9. The tool of claim 1 in which said sensor unit is an inertial measurement unit.

10. The tool of claim 9, wherein said estimation means estimates position as spatial coordinates of said tool body on the basis of the output of the inertial measurement unit.

11. The tool of claim 1 wherein said drill string further comprises a bottom hole assembly to which said tool body first end is connectable.

12. The tool of claim 11 wherein said bottom hole assembly further comprises said control means.

13. The tool of claim 1 wherein said tool body further comprises said control means.

14. The tool of claim 1 wherein said drilling tool further comprises a surface unit comprising said control means.

15. The tool of claim 14 wherein said drilling tool further comprises a communication means arranged to enable two-way communications between said tool body and said surface unit.

16. The tool of claim 1 wherein said tool body further comprises a flexible shaft.

17. The tool of claim 16 wherein said shaft has a first end and a second end corresponding to said first and second ends of said tool body.

18. The tool of claim 17 wherein said first end of said shaft is connectable to said drive member and said second end of said shaft is connectable to a said drill bit.

19. The tool of claim 18 wherein said shaft is arranged to transmit rotary motion from said first end to said second end.

20. The tool of claim 19 wherein said deflection member is a flexible shaft deflection member arranged to deflect said second end of said shaft away from said longitudinal axis of said tool body.

21. The tool of claim 16 wherein said tool body has an outer housing and said shaft is positioned within said outer housing.

22. The tool of claim 16 wherein said tool body further comprises a further shaft positioned between said drive member and said flexible shaft.

23. The tool of claim 22 wherein said sensor unit is positioned within said further shaft.

24. The tool of claim 1 wherein said sensor unit comprises at least one gyroscope and at least one accelerometer.

25. The tool of claim 24 wherein said gyroscopes are arranged to measure angular rate around a plurality of orthogonal axes and said accelerometers are arranged to measure specific force acceleration along a plurality of orthogonal axes.

26. The tool of claim 25 wherein said sensor unit comprises an orthogonal triad of linear accelerometers and two dual-axis gyroscopes.

27. The tool of claim 1 further comprising bore hole length measurement means arranged to measure the distance of said steerable drilling tool along said bore hole.

28. The tool of claim 27 wherein said estimation means is further arranged to estimate the inclination and azimuthal deviation of said tool body, on the basis of said measurements of angular rate and acceleration and as a function of bore hole length.

29. The tool of claim 28 wherein said pre-stored direction and/or position information comprises pre-planned borehole inclination and azimuthal deviation parameters as a function of bore hole length.

30. The tool of claim 29 wherein said control means is further arranged to calculate the difference between the estimated inclination and azimuthal deviation of the bore hole at a given bore hole length and the pre-planned inclination and azimuthal deviation parameters at a corresponding bore hole length.

31. The tool of claim 30 wherein said pre-stored position information comprises preplanned borehole position parameters as a function of bore hole length.

32. The tool of claim 31 wherein said control means is further arranged to calculate the difference between the estimated position of the bore hole at a given bore hole length and the preplanned position parameters at a corresponding bore hole length.

33. The tool of claim 1, wherein said drive member is a drill string which is connected to a motor.

34. The tool of claim 1, wherein said drive member is a mud motor.

35. A method of drilling bore holes comprising the steps of:

connecting a steerable rotary drilling tool to a drill bit and a drive member;

rotating the steerable rotary drilling tool using said drive member so as to cause the drill bit to rotate and commence drilling;

estimating the direction and/or position of the drilling tool on the basis of the output of a sensor unit of the steerable rotary drilling tool;

calculating the difference between the estimated direction and/or position and corresponding prestored direction and/or position information; and deflecting the steerable rotary drilling tool on the basis of said difference; wherein said estimating step includes a step of preventing said sensor unit moving relative to an Earth fixed reference frame by mechanically decoupling the sensor unit from the tool body of said steerable rotary tool using a counter-rotating platform, wherein the sensor unit is positioned on the counter-rotating platform.

36. The method of claim 35, wherein said step of maintaining said sensor unit substantially stationary includes rotatably disposing the sensor unit on the steerable rotary drilling tool to rotate in a direction opposite the direction of the rotary motion of said tool body, such that said sensor unit remains substantially stationary with respect to an Earth fixed reference frame.

37. The method of claim 36, further comprising the steps of detecting the rate of rotary motion of the tool body and rotating the sensor unit, in response to the detected rate, such that it remains substantially stationary with respect to an Earth fixed reference frame.

38. The method of claim 35 wherein said steerable rotary drilling tool has a stationary outer housing and said sensor unit is positioned within the outer housing, such that said sensor unit remains substantially stationary with respect to an Earth fixed reference frame.

39. The method claim 35 further comprising the steps of measuring angular rate around a plurality of orthogonal axis and measuring specific force acceleration along a plurality of orthogonal axis.

40. The method of claim 35, wherein position is estimated as spatial coordinates.

41. A method of drilling bore holes comprising the steps of:

connecting a steerable rotary drilling tool to a drill bit and a drive member.

rotating the steerable rotary drilling tool using said drive member so as to cause the drill bit to rotate and commence drilling;

estimating the direction and/or position of the drilling tool on the basis of the output of a sensor unit of the steerable rotary drilling tool, the sensor unit being disposed on a counter-rotating platform, which is disposed on said steerable rotary drilling tool to prevent said sensor unit from moving relative to an Earth fixed reference frame by decoupling said sensor unit from the rotary motion of the tool body of said steerable rotary drilling tool;

calculating the difference between the estimated direction and/or position and corresponding prestored direction and/or position information; and deflecting the steerable rotary drilling tool on the basis of said difference.

42. The method of claim 41, wherein said sensor unit is rotatably disposed on the steerable rotary drilling tool to rotate in a direction opposite the direction of the rotary motion of said tool body, such that said sensor unit remains substantially stationary with respect to an Earth fixed reference frame.

43. The method of claim 41, further comprising the steps of measuring angular rate around a plurality of orthogonal axis and measuring specific force acceleration along a plurality of orthogonal axis.

44. The method of claim 43, wherein said step of estimating further comprises a step of estimating inclination and azimuthal deviation in response to said measurements of angular rate and acceleration.

45. The method of claim 44, further comprising the step of measuring the distance of said tool along the bore hole.

46. The method of claim 45, wherein said estimation of inclination and azimuthal deviation is expressed as a function of distance along the bore hole.

47. The method of claim 45, wherein said estimation of position is expressed as a function of distance along the bore hole.

48. The method of claim 47, wherein position is estimated as spatial coordinates.

49. The method of claim 42, wherein said step of estimating further comprises a step of estimating inclination and azimuthal deviation in response to said measurements of angular rate and acceleration.

50. The method of claim 43, further comprising the step of measuring the distance of said tool along the bore hole.

51. The method of claim 44, wherein said estimation of inclination and azimuthal deviation is expressed as a function of distance along the bore hole.

52. The method of claim 44, wherein said estimation of position is expressed as a function of distance along the bore hole.

53. A steerable bore hole drilling tool comprising:

a tool body having a first end connectable to a drive member and a second end connectable to a drill bit, the tool body arranged to transmit rotary motion from said first end to said second end;

a deflection member disposed on the tool body to deflect said second end away from a longitudinal axis of the tool body;

a sensor unit;

an estimator arranged to estimate the direction and/or position of the tool body on the basis of the output of said sensor unit;

a control to calculate the difference between the estimated direction and/or position and corresponding pre-stored direction and/or position information and to control said deflection member so as to deflect said second end on the basis of said difference; and a counter-rotating platform disposed on the tool body, said sensor unit being disposed on said counter-rotating platform, wherein said counter-rotating is arranged to mechanically decoupled said sensor unit from the tool body, and said counter-rotating platform is further arranged to decoupled said sensor unit from the rotary motion of said tool body, such that in use, the sensor unit remains substantially stationary with respect to an Earth fixed reference frame.

* * * * *

UNITED STATES PATENT AND TRADEMARK OFFICE

CERTIFICATE OF CORRECTION

PATENT NO. : 8,393,413 B2
APPLICATION NO. : 11/571849
DATED : March 12, 2013
INVENTOR(S) : Weston et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1111 days.

Signed and Sealed this
First Day of September, 2015

Michelle K. Lee

Michelle K. Lee
*Director of the United States Patent and Trademark Office*